US007104032B2

(12) United States Patent
Spatafora et al.

(10) Patent No.: US 7,104,032 B2
(45) Date of Patent: Sep. 12, 2006

(54) METHOD AND MACHINE FOR WRAPPING AN ARTICLE

(75) Inventors: Mario Spatafora, Bologna (IT); Loris Grepioni, Castel Maggiore (IT)

(73) Assignee: G.D.Societa per Azioni, Bologna (IT)

( * ) Notice: Subject to any disclaimer, the term of this patent is extended or adjusted under 35 U.S.C. 154(b) by 0 days.

(21) Appl. No.: 10/499,322

(22) PCT Filed: Dec. 18, 2002

(86) PCT No.: PCT/IT02/00800

§ 371 (c)(1),
(2), (4) Date: Nov. 1, 2004

(87) PCT Pub. No.: WO03/051716

PCT Pub. Date: Jun. 26, 2003

(65) Prior Publication Data

US 2005/0076619 A1 Apr. 14, 2005

(30) Foreign Application Priority Data

Dec. 18, 2001 (IT) ..... BO2001A0767

(51) Int. Cl.
*B65B 11/28* (2006.01)

(52) U.S. Cl. ..... 53/466; 53/234; 53/387.2

(58) Field of Classification Search ..... 53/234, 53/387.2

See application file for complete search history.

(56) References Cited

U.S. PATENT DOCUMENTS

| | | | | | |
|---|---|---|---|---|---|
| 2,435,878 | A * | 2/1948 | Dunning | 53/491 |
| 2,952,957 | A * | 9/1960 | Luczek et al. | 53/228 |
| 3,511,014 | A * | 5/1970 | Kochalski | 53/436 |
| 4,548,019 | A * | 10/1985 | Kruse | 53/170 |
| 4,823,536 | A * | 4/1989 | Manservigi et al. | 53/466 |
| 4,999,970 | A * | 3/1991 | Bamrungbhuet et al. | 53/176 |
| 5,038,546 | A * | 8/1991 | Oberdorf | 53/202 |
| 5,305,580 | A | 4/1994 | Draghetti | |
| 6,324,817 | B1 * | 12/2001 | Ghini et al. | 53/466 |
| 6,766,625 | B1 * | 7/2004 | Cinotti | 53/230 |

FOREIGN PATENT DOCUMENTS

GB 453 165 A 9/1936

* cited by examiner

*Primary Examiner*—John Sipos
(74) *Attorney, Agent, or Firm*—Birch, Stewart, Kolasch & Birch, LLP

(57) ABSTRACT

A method and machine for wrapping an article, whereby the article is fed through a feed station, where the article is applied with a respective sheet of wrapping material which is folded into an L about the article, so as to have a free edge not contacting the article, and through a follow-up wrapping station, where the sheet of wrapping material is folded about the article to form a tubular wrapping by applying the free edge onto the article; between the feed station and the wrapping station, the free edge of the L-folded sheet of wrapping material is subjected to traction in substantially the opposite direction to the travelling direction of the article by subjecting the first free edge to suction, so as to smooth the sheet of wrapping material onto the article.

13 Claims, 2 Drawing Sheets

METHOD AND MACHINE FOR WRAPPING AN ARTICLE

TECHNICAL FIELD

The present invention relates to a method of wrapping an article.

The present invention may be used to advantage in the tobacco industry, for overwrapping packets of cigarettes in respective sheets of transparent plastic material (typically polypropylene), to which the following description refers purely by way of example.

BACKGROUND ART

A packet of cigarettes is known to be fed through a feed station, where it is applied with a respective sheet of polypropylene overwrapping material, which is folded about the packet into a U- or L-shaped configuration; the packet, together with the respective sheet of overwrapping material, is then fed to a folding station, where the sheet of overwrapping material is folded further about the packet to form a tubular wrapping, which is then stabilized by heat sealing the superimposed lateral portions of the sheet of overwrapping material; and, finally, the tubular wrapping is closed by folding the outer ends of the tubular wrapping onto the packet, and is stabilized by heat sealing the superimposed end portions of the sheet of wrapping material.

Though widely used on machines (known as cellophaning machines) for overwrapping packets of cigarettes, by being easy to implement and permitting high operating speeds, the above wrapping method has been found to result at times in poor-quality overwrapping, by the sheet of overwrapping material about the packet of cigarettes presenting creases which, while not impairing the function of the overwrapping itself, are considered unsightly by consumers.

GB-453165-A1 discloses a wrapping machine of the kind in which an article and a wrapper are moved by an article carrier to a delivery station from a feeding-in station between which and the carrier a wrapper is located, the wrapper being drawn substantially completely around the article during the motion of the latter as it passes from the feeding-in station onto the carrier and to the delivery station. As the article enters the carrier the wrapper is clamped between the article and a backing plunger and is drawn out from under a roll, which serves to keep the wrapper straight irrespective of irregularities in the shape of the article by keeping a proper tension on the wrapper. However, the solution given by GB-453165-A1 for avoiding the formation of creases in the wrapping cannot be implemented in an easy and cheap manner to a modern cellophaning machine for overwrapping packets of cigarettes, due to the high operational speed of such machines.

U.S. Pat. No. 5,305,580-A1 discloses a method of producing tubular wrappings for parallelepiped products or similar, whereby the products and respective portions of wrapping material are fed successively on to a respective first and second conveyor and fed continuously along a common route, along which each portion of wrapping material is transferred on to the first conveyor by a pair of supports supporting a respective product and supported on and moving with the first conveyor, each pair of supports being rotated for wrapping a respective portion of wrapping material about the respective product and so forming a respective tubular wrapping, the opposite portions of which are overlapped and welded together by a welding device assigned to each pair of supports.

DISCLOSURE OF INVENTION

It is an object of the present invention to provide a method of wrapping an article, designed to eliminate the aforementioned drawbacks, and which, in particular, is easy and cheap to implement.

According to the present invention, there is provided a method of wrapping an article as recited by claim 1.

According to the present invention, there is further provided a method of wrapping an article as recited by claim 7.

The present invention also relates to a machine for wrapping an article.

According to the present invention, there is provided a machine for wrapping an article as recited by claim 10.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
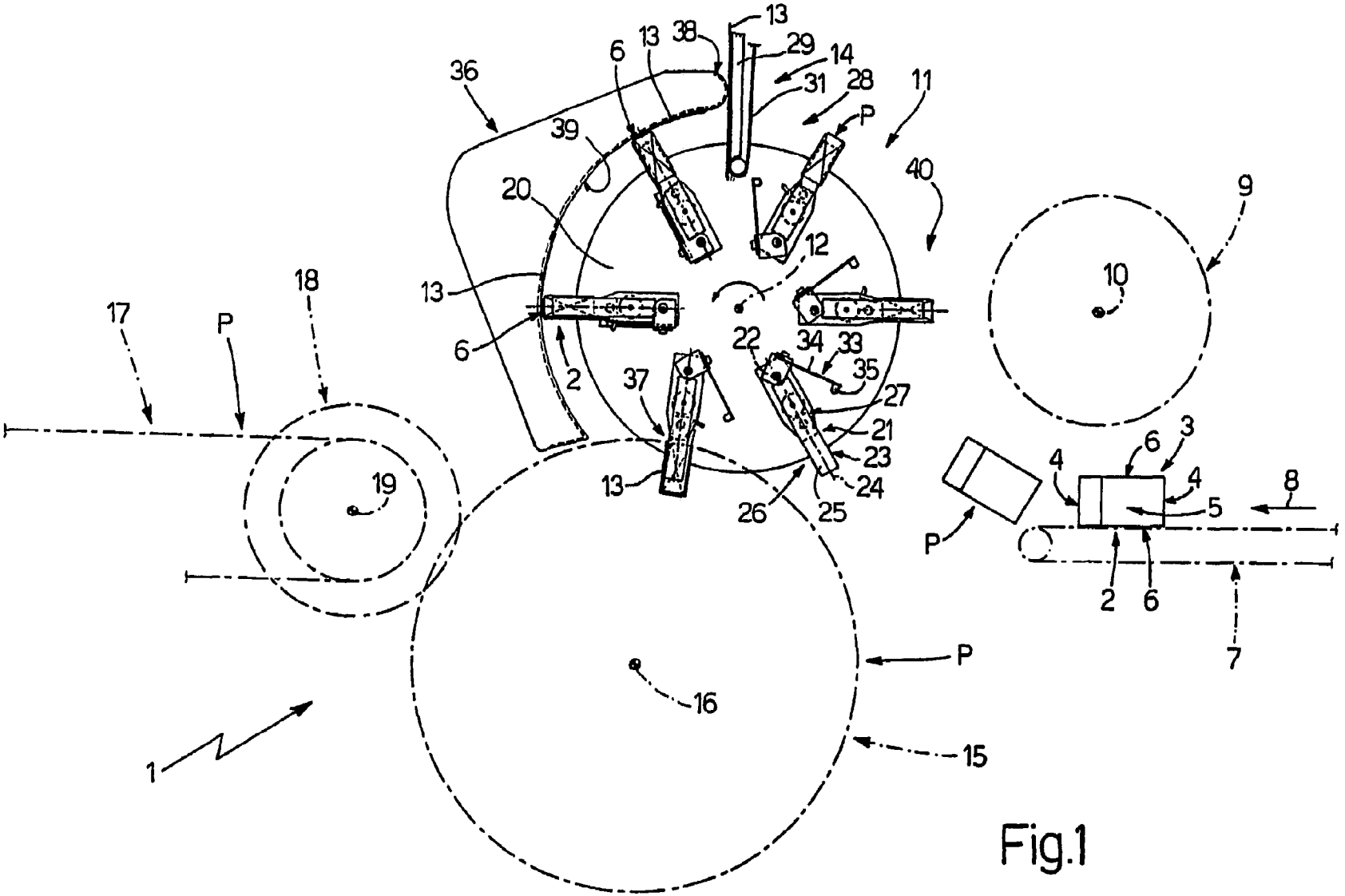
FIG. 1 shows a schematic side view, with parts removed for clarity, of a preferred embodiment of a cellophaning machine, for packets of cigarettes, in accordance with the present invention.

Number 1 in FIG. 1 indicates as a whole a continuous cellophaning machine for packets 2 of cigarettes, each of which is in the form of a rectangular parallelepiped having a lateral surface 3 bounded at opposite ends by parallel end walls 4. More specifically, lateral surface 3 is defined by two parallel, opposite major lateral walls 5, and by two parallel, opposite minor lateral walls 6 perpendicular to major lateral walls 5.

Machine 1 comprises a horizontal input belt conveyor 7 for feeding an orderly succession of on-edge packets 2, i.e. positioned with a minor lateral wall 6 resting on input conveyor 7, in an axial direction 8. Machine 1 also comprises a transfer wheel 9 which rotates about an axis 10 perpendicular to the FIG. 1 plane and crosswise to axial direction 8, is tangent to input conveyor 7, and, in known manner not shown, picks up packets 2 successively off input conveyor 7, turns packets 2 through 90°, and feeds packets 2 on edge to a wrapping wheel 11 rotating about an axis 12 parallel to axis 10.

Wrapping wheel 11 receives packets 2 successively from transfer wheel 9, and receives relative sheets 13 of wrapping material—normally polypropylene—from a feed assembly 14 to fold sheets 13 of wrapping material into an L about relative packets 2.

Machine 1 also comprises a further wrapping wheel 15 which rotates about an axis 16 parallel to axis 10, and receives packets 2 on edge and relative L-folded sheets 13 of wrapping material to form a respective tubular wrapping about each packet 2, and to stabilize each tubular wrapping by heat sealing the two superimposed lateral end portions of relative sheet 13 of wrapping material.

Machine 1 also comprises an output conveyor 17 for feeding packets 2 successively to an output of machine 1, and for closing the ends of the relative tubular wrappings; and a transfer wheel 18 rotating about an axis 19 parallel to axis 10, and for feeding packets 2 and the relative tubular wrappings successively from wrapping wheel 15 to output conveyor 17.

Input conveyor 7, transfer wheel 9, wrapping wheel 11, wrapping wheel 15, transfer wheel 18, and output conveyor 17 define, along machine 1, a wrapping path P along which packets 2 travel continuously.

Wrapping wheel 11 is fitted to a frame (not shown) in a position substantially tangent to transfer wheel 9, so as to rotate continuously and anticlockwise in FIG. 1 about axis 12. Wrapping wheel 11 comprises a powered disk 20 coaxial with and rotating about axis 12; and a number of gripping heads 21 equally spaced about axis 12 and fitted to disk 20 to oscillate, with respect to disk 20 and under the control of a known cam device (not shown), about respective axes 22 parallel to axis 12. Each gripping head 21 comprises a respective gripper 23 which extends along an axis 24 radial with respect to relative axis 22, projects outwards of disk 20, and comprises two jaws 25 movable with respect to each other—in a direction parallel to relative axis 22 and under the control of a known cam actuating device not shown—to and from a closed position in which the two jaws 25 define a relative seat 26 for a corresponding packet 2 positioned with a minor lateral wall 6—opposite the one formerly facing axis 10 of transfer wheel 9—facing axis 12, and with end walls 4 contacting jaws 25.

From a front lateral surface—with reference to the rotation direction of wrapping wheel 11—of each gripping head 21, a transverse plate 27, parallel to relative axis 22 and located between relative seat 26 and relative axis 22, projects forwards and acts as a stop for a front edge of a relative sheet 13 of wrapping material fed by feed assembly 14 to a feed station 28 substantially synchronously with the passage of a gripping head 21 through feed station 28.

Figure 2:
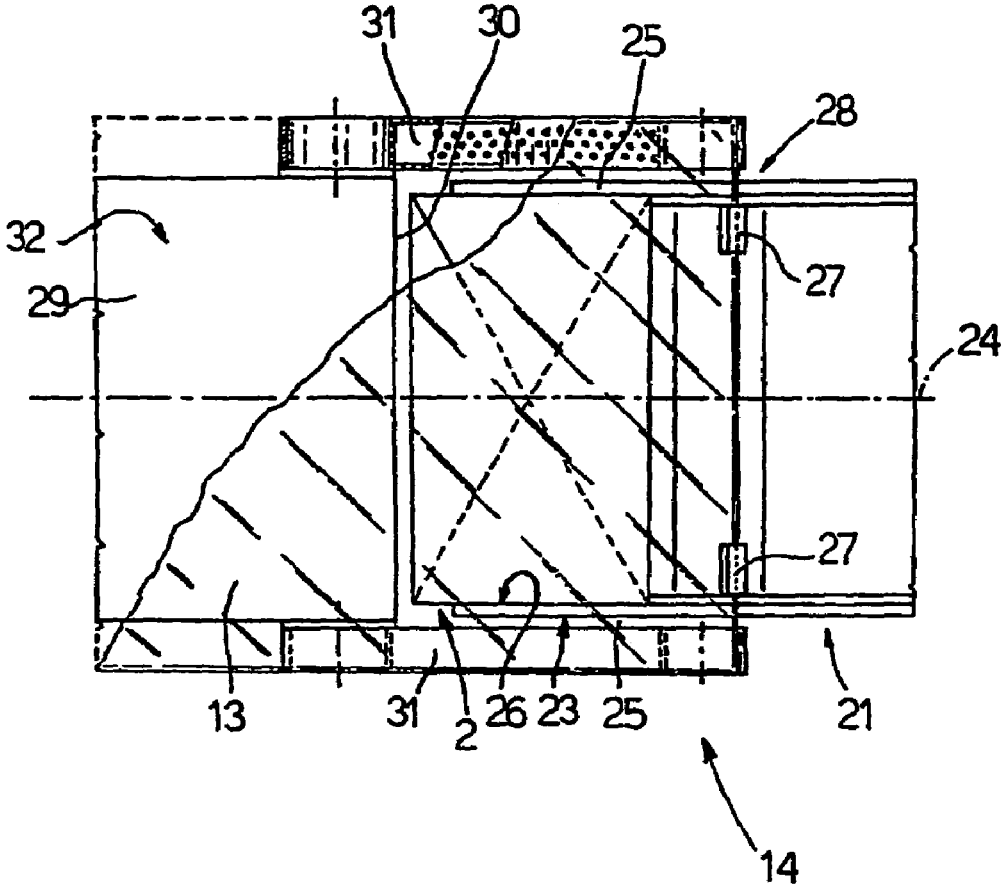
FIG. 2 shows a larger-scale side view of a detail in FIG. 1.

As shown in FIG. 2, feed assembly 14—of known type—comprises a substantially C-shaped plate 29 parallel to and positioned radially with respect to axis 12, with its concavity facing the periphery of wrapping wheel 11 to define a passage 30 for grippers 23 and relative packets 2; and two belts 31 permeable to air, and which feed sheets 13 of wrapping material along a surface 32 of plate 29, located at the front in the travelling direction of gripping heads 21, and having suction holes for retaining sheets 13 of wrapping material on belts 31 and in a position closing passage 30.

As shown in FIG. 1, each gripping head 21 also comprises a further gripper 33 defined by a fixed jaw, in turn defined by a body of gripping head 21, and by a movable jaw 34 hinged to relative axis 22 to oscillate, with respect to the body of relative head 21, between an open position, and a closed position in which an end pad 35 of jaw 34 is located radially outwards of relative plate 27, at relative seat 26, and contacting the major lateral wall 5 of relative packet 2 located frontwards in the rotation direction of wrapping wheel 11.

Wrapping wheel 11 is provided with a fixed folding and guide plate 36 which extends, coaxially with axis 12, between feed station 28 and a transfer station 37 where packets 2 and relative sheets 13 of wrapping material are transferred to wrapping wheel 15, and comprises, at the end facing feed station 28, a rounded folding edge 38 for folding each sheet 13 of wrapping material onto the outer minor lateral wall 6 of relative packet 2 opposite the one facing axis 12. On the side facing the periphery of wrapping wheel 11, plate 36 comprises a suction surface 39 for braking and smoothing sheets 13 of wrapping material onto said relative outer minor lateral walls 6.

In actual use, each gripping head 21 approaches a transfer station 40 (defined at the point of tangency between transfer wheel 9 and wrapping wheel 11) with grippers 23 and 33 open to enable jaws 25 to receive a relative packet 2 fed to transfer station 40 by a corresponding known gripper (not shown) on transfer wheel 9; and, at transfer station 40, jaws 25 are closed onto respective end walls 4 of relative packet 2 to clamp packet 2 in an axial position in which one of the minor lateral walls 6 of packet 2 faces axis 12, and the two major lateral walls 5 of packet 2 are positioned substantially radially with respect to disk 20.

On receiving relative packet 2, each gripping head 21 moves on to feed station 28 supplying sheets 13, and respective gripper 23 engages passage 30 of plate 29. At the same time, a relative sheet 13 of wrapping material is supplied by feed assembly 14 so that, when relative gripper 23 engages passage 30, a front edge of sheet 13 of wrapping material is arrested on plate 27 and is in this position on contacting the front major lateral wall 5 of relative packet 2 and upon simultaneous closure of relative gripper 33 which, clamping sheet 13 on said front major lateral wall 5 of relative packet 2, enables relative gripping head 21 to draw sheet 13 off the front suction surface 32 of plate 29 and insert it, together with relative packet 2, beneath plate 36.

When the portion of sheet 13 projecting outwards of relative packet 2 contacts folding edge 38 of plate 36, sheet 13 is folded into an L about relative packet 2, so as to be positioned with a first portion projecting inwards, with respect to the front major lateral wall 5 of relative packet 2, to form a relative end flap, with a second portion centrally contacting the front major lateral wall 5 of relative packet 2, with a third portion centrally contacting the outer minor lateral wall 6 of relative packet 2, and with a last portion projecting rearwards with respect to said outer minor lateral wall 6, and which is retained by suction on suction surface 39 of plate 36, and so braked by plate 36 to smooth sheet 13 perfectly onto said front major lateral wall 5 and said outer minor lateral wall 6 of relative packet 2.

Each sheet 13 is kept in this position until relative gripping head 21 reaches transfer station 37, where sheet 13 folded into an L about relative packet 2 is transferred to a corresponding known seat (not shown) on wrapping wheel 15, in which the sheet is folded into a U about relative packet 2.

It is important to note that the guide plate 36 is independent and separated from the feed station 28; in other words, the suction surface 39 of the guide plate 36 feed engages progressively the free rearwardly projecting portion of each sheet 13 when the sheet 13 progressively is leaving the feed station 28.

Tests have shown suction plate 36 to be capable of smoothing out and eliminating any creases or wrinkles in each sheet 13 until sheet 13, together with relative packet 2, is engaged by a respective known seat (not shown) on wrapping wheel 15, in which sheet 13 is clamped with respect to packet 2 to stabilize the smoothing action of plate 36. Suction plate 36 therefore provides, cheaply and easily, for obtaining an overwrapping of each packet 2 of superior quality with no unsightly creases or wrinkles of respective sheet 13 of overwrapping material.

The above method of wrapping an article is obviously not limited to polypropylene overwrappings for packets of cigarettes, and may be applied to any type of wrapping material from which to form a tubular wrapping about an article by folding a sheet of flexible, i.e. non-rigid, wrapping material.

The invention claimed is:

1. A method of wrapping an article, whereby the article is fed along a circular wrapping path through a feed station, where the article is applied with a respective sheet of wrapping material which is folded at least into an L about the article so as to have a first free edge not contacting the article, and through a follow-up wrapping station, where the sheet of wrapping material is folded about the article to form a tubular wrapping by applying the first free edge onto the article; between the feed station and the wrapping station, the first free edge of the L-folded sheet of wrapping material being subjected to traction in substantially the opposite direction to the travelling direction of the article by subjecting the first free edge to suction, so as to smooth the sheet of wrapping material onto the article; the method being characterized in that said traction is applied to the first free edge by subjecting the first free edge to suction by a suction body in a fixed position; the suction body comprising a suction surface located along the wrapping path of the article so as to be, at each point of said surface, substantially tangent to the article.

2. A method as claimed in claim 1, wherein, between the feed station and the wrapping station, a second edge of the sheet of wrapping material, substantially opposite the first free edge, is clamped in a fixed position with respect to the article.

3. A method as claimed in claim 1, wherein the suction body is independent and separated from the feed station, and thus the suction body engages progressively the first free edge of the L-folded sheet of wrapping material when the sheet of wrapping material is progressively leaving the feed station.

4. A method as claimed in claim 1, wherein, at the feed station, the sheet of wrapping material is folded into an L about the article so as to have a first free edge not contacting the article; and, at the follow-up wrapping station, the sheet of wrapping material is first folded into a U about the article by applying part of the first free edge to the article, and is subsequently folded to complete the tubular wrapping; the sheet of wrapping material being folded into a U about the article by transferring the article and the sheet of wrapping material to a respective wrapping seat.

5. A method as claimed in claim 1, wherein said article is a parallelepiped-shaped container for tobacco articles.

6. A method as claimed in claim 1, wherein said article is fed continuously along the wrapping path.

7. A method of wrapping an article substantially in the form of a rectangular prism defined axially by two opposite end surfaces and defined laterally by two major lateral surfaces and two minor lateral surfaces parallel to a longitudinal axis of the rectangular prism; the article being overwrapped as it is fed along a given circular wrapping path and in a given travelling direction; the method comprising:

a step of applying a relative sheet of wrapping material to the article;

a first folding step to fold the sheet of wrapping material into a U about the article, so that the sheet of wrapping material has two projecting lateral portions, each projecting from a respective said end surface;

a second folding step to fold the sheet of wrapping material further about the article, so as to form, about the article, a tubular wrapping comprising two tubular appendixes projecting from respective said end surfaces of the article and defined by said two projecting lateral portions;

a sealing step to stabilize said tubular wrapping; and a third folding step to fold each said tubular appendix onto the respective end surface of the article to obtain a closed overwrapping;

said first folding step comprising a first substep, in which said sheet of wrapping material is folded into an L, and a second substep, in which the L-folded said sheet of wrapping material is further folded into a U; said first substep being performed by clamping said sheet of wrapping material with respect to said article, so that an intermediate portion of the sheet of wrapping material is positioned with a respective central portion contacting a first said lateral surface facing frontwards in said travelling direction, a first end flat of the sheet of wrapping material projects from said first lateral surface, and a remaining portion of the sheet of wrapping material projects from said first lateral surface on the opposite side with respect to said first end flap; said first substep also being performed by folding said remaining portion of the sheet of wrapping material squarely and rearwards with respect to said travelling direction; and said remaining portion, once folded squarely, being braked by pneumatic suction to smooth said sheet of wrapping material onto said article; the method being characterized in that said braking action is applied to said remaining portion by subjecting the remaining portion to suction by a suction body in a fixed position; the suction body comprising a suction surface located along the wrapping path of the article so as to be, at each point, of said surface, substantially tangent to the article.

8. A method as claimed in claim 7, wherein said remaining portion is folded squarely and rearwards by moving the article along said wrapping path and by interference with a fixed folding member comprising a folding edge for folding said remaining portion rearwards, and a follow-up suction surface extending along said wrapping path and cooperating with the folded said remaining portion to smooth said sheet of wrapping material onto the article.

9. A method as claimed in claim 7, wherein said second substep is performed by transferring the article and the L-folded said sheet of wrapping material from a first to a second seat, which are movable along respective portions of said wrapping path and positioned facing each other during transfer; the U-folded said sheet of wrapping material being positioned inside said second seat so that a first and a second end flap of the sheet of wrapping material project from an inlet of said second seat and towards said first seat, and each said projecting lateral portion of the sheet of wrapping material projects from said second seat transversely with respect to said first and said second end flap.

10. A machine for wrapping an article; the machine comprising a conveyor for feeding the article along a wrapping path through a feed station, where the article is applied with a respective sheet of wrapping material which is folded at least into an L about the article so as to have a first free edge not contacting the article, and through a follow-up wrapping station, where the sheet of wrapping material is folded about the article to form a tubular wrapping by applying the first free edge onto the article; the machine also comprising a braking device, which is located between the feed station and the wrapping station, is independent and separated from the feed station and is able to subject the first free edge of the L-folded sheet of wrapping material to traction in substantially the opposite direction to the travelling direction of the article, so as to smooth the sheet of wrapping material onto the article; the machine being characterized in that the braking device comprises a suction body located in a fixed position tangent to the first wrapping wheel; the suction body comprising a suction surface located along the wrapping path of the article so as to be substantially tangent, at each point of said surface, to the article to exert braking action on the first free edge by means of suction.

11. A machine as claimed in claim 10, wherein said conveyor comprises a first wrapping wheel which has at least one first peripheral seat for receiving the article, and which feeds the article through the feed station; and a follow-up second wrapping wheel which has at least one second peripheral seat for receiving the article, and which feeds the article through the wrapping station.

12. A machine as claimed in claim 11, wherein the first peripheral seat comprises clamping members for clamping a second edge of the sheet of wrapping material, substantially opposite the first free edge, in a fixed position with respect to the article.

13. A machine as claimed in claim 10, wherein said braking device comprises a fixed folding edge for folding the sheet of wrapping material at least into an L about the article.

* * * * *

UNITED STATES PATENT AND TRADEMARK OFFICE

CERTIFICATE OF CORRECTION

PATENT NO. : 7,104,032 B2
APPLICATION NO. : 10/499322
DATED : September 12, 2006
INVENTOR(S) : Mario Spatafora et al.

It is certified that error appears in the above-identified patent and that said Letters Patent is hereby corrected as shown below:

ON THE TITLE PAGE:

At item (73) Assignee, change:

"G.D.Societa per Azioni, Bologna (IT)" to

--G.D SOCIETA' PER AZIONI, Bologna (IT)--.

Signed and Sealed this

Thirty-first Day of August, 2010

David J. Kappos

David J. Kappos
*Director of the United States Patent and Trademark Office*